US005889362A

United States Patent [19]

Barten

[11] Patent Number: 5,889,362

[45] **Date of Patent: *Mar. 30, 1999**

[54] COLOR DISPLAY TUBE HAVING A REDUCED DEFLECTION DEFOCUSING

[75] Inventor: Piet G. J. Barten, Knegsel, Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 775,903

[22] Filed: Jan. 2, 1997

[30] Foreign Application Priority Data

Jan. 2, 1996 [NL] Netherlands ..... 1002009

[51] Int. Cl.[6] ..... H01J 33/00; H01J 29/80; H01J 31/00

[52] U.S. Cl. ..... 313/420; 313/403; 313/477 R

[58] Field of Search ..... 313/402, 403, 313/408, 415–416, 420, 421, 422, 426, 461, 470, 472, 477 R; 348/325, 805; 315/370

[56] References Cited

U.S. PATENT DOCUMENTS

| | | | |
|---|---|---|---|
| 3,777,204 | 12/1973 | Robbins et al. | 313/403 |
| 5,055,736 | 10/1991 | Yun et al. | 313/402 |
| 5,099,169 | 3/1992 | Vriens | 313/403 |
| 5,170,102 | 12/1992 | Sluyterman et al. | 315/370 |

OTHER PUBLICATIONS

"The 20AX System and Picture Tube", by P.G.J. Barten, IEEE Trans. On Broadcast and TV Receiver, vol. 20, No. 4, pp. 286–292, Nov. 1974.

"Theorie des Moire bei Schattenmasken–Farbbildrohren", by P.G.J. Barten, Valvo Berichte, vol. 15, No. 3, pp. 79–92, Nov. 1969.

*Primary Examiner*—Sandra O'Shea
*Assistant Examiner*—Mack Haynes

[57] ABSTRACT

Color display tube comprising an in-line electron gun, a self-convergent deflection coil, a shadow mask having a pattern of apertures and a display screen having a pattern of phosphor dots. The aperture pattern consists of apertures arranged in vertical rows with a substantially equal vertical aperture spacing between the centers of each pair of consecutive apertures in each row. The vertical rows of apertures are alternately staggered through half the vertical aperture spacing. The electron gun generates three electron beams in the vertical plane through the axis of the color display tube. The phosphor dots are arranged in vertical triplets. Both the apertures and the phosphor dots are horizontally elongated. The horizontal spacing between the vertical rows of apertures is preferably smaller than ½*√3 times the vertical aperture spacing. A better definition due to a reduced deflection defocusing is achieved with this color display tube, without Moiré phenomena occurring.

5 Claims, 3 Drawing Sheets

COLOR DISPLAY TUBE HAVING A REDUCED DEFLECTION DEFOCUSING

BACKGROUND OF THE INVENTION

The invention relates to a color display tube comprising an in-line electron gun, a self-convergent deflection coil, a shadow mask having a pattern of apertures and a display screen having a pattern of phosphor dots, in which the aperture pattern consists of apertures arranged in vertical rows with a substantially equal vertical aperture spacing between the centers of each pair of consecutive apertures in each row, the vertical rows of apertures being alternately staggered through half the vertical aperture spacing.

A color display tube of this type is generally known. The shadow mask may be a hexagonal mask having circular apertures, and the phosphor dot pattern may have phosphor dots arranged in horizontal triplets. Alternatively, the shadow mask may be an aperture pattern with vertically extending elongated apertures, or slits, in which case the phosphor dot pattern consists of continuous vertical phosphor strips. In all cases, the electron gun is adapted in such a way that it generates three electron beams in the horizontal plane through the axis of the color display tube. In fact, only color display tubes comprising horizontal in-line electron guns are currently marketed worldwide.

More particularly, three electron beams located in a horizontal plane and each being modulated with the information of one of the three colors red, green and blue are used in current color display tubes for displaying video images or computer data. The electron beams are directed onto a point in the center of the display screen and are jointly magnetically deflected to other parts of the display screen by means of a self-convergent deflection coil, while the beams always come together, or converge, at one point. A metal shadow mask provided with apertures or slits is arranged at a short distance from the display screen, which shadow mask partly passes the beams in such a way that each of the three electron beams impinges upon the display screen exclusively at locations where phosphors have been provided, which then luminesce in the color with which the incident electron beam has been modulated.

The magnetic deflection system used in known color display tubes has the drawback that, upon deflection in the horizontal direction, the horizontal dimension of the electron dot on the display screen is enlarged and also defocused in the vertical direction, so that the definition of the displayed image is affected. These effects quadratically increase with the horizontal deflection and become most clearly manifest in color display tubes having larger deflection angles, for example 110°, which, due to their small depth, are particularly used in color display tubes having larger display screen dimensions.

The interested reader will find further background information in: "The 20AX System and Picture Tube, IEEE Trans. on Broadcast and TV Receivers", by P. G. J. Barten, vol. 20, no. 4, pp. 286–292, November 1974.

It is an object of the invention to reduce the deflection defocusing in conventional color display tubes by proposing a novel color display tube arrangement.

To this end, the invention provides a color display tube of the type described in the opening paragraph, which is characterized in that the electron gun is adapted in such a way that it generates three electron beams in the vertical plane through the axis of the color display tube, in that the phosphor dots are arranged in vertical triplets, and in that both the apertures and the phosphor dots are horizontally elongated.

The core idea of the proposed novel arrangement of a color display tube is that the electron gun is adapted in such a way that it does not generate three electron beams in the horizontal plane, as is conventional practice, but in the vertical plane through the axis of the color display tube, which technical measure leads to a strong reduction of the defocus caused by deflection in the image displayed on the display screen.

It will be evident to those skilled in the art that the deflection system should then be adapted in such a way that the self-convergence of the electron beams is maintained. In the proposed novel arrangement of the color display tube, the magnetic field of the horizontal deflection coil has the character of that of the vertical deflection coil of the conventional deflection system, and the magnetic field of the vertical deflection coil has the character of that of the horizontal deflection coil of the conventional deflection system. The combination of horizontal and vertical deflection coil is referred to as a self-convergent deflection coil.

It is true that said defocusing effects now occur upon deflection in the vertical direction, but since, due to the rectangular image format, deflection in the vertical direction is much smaller than deflection in the horizontal direction, and since defocusing effects quadratically increase with the deflection, they are practically negligible. This particularly applies to color display tubes having a display screen format of 16:9, in which the vertical deflection is only $9/16$ of the horizontal deflection and the defocusing is thus reduced by the square value thereof, down to approximately 0.32 of the defocusing in the horizontal direction of a conventional color display tube.

However, when the electron beams are located in a vertical plane, not only the deflection system should be adapted, but also the configuration of the aperture pattern in the shadow mask and the associated configuration of the phosphor dot pattern on the display screen. In this case, it is obvious to rotate the two patterns simply through 90°.

However, this produces very troublesome Moiré phenomena consisting of dark and light stripes in the image displayed on the display screen, which phenomena are due to interference between the horizontal scanning lines and the aperture pattern in the shadow mask. This Moiré effect becomes particularly manifest when using a shadow mask with vertical slits and a phosphor dot pattern consisting of continuous strips. However, the effect also occurs when a shadow mask having circular apertures arranged in a hexagonal pattern is rotated through 90°, which type of shadow mask is particularly used in color display tubes for monitors. In conventional color display tubes, a mask of this type has such a configuration that the aperture pattern consists of circular apertures arranged in vertical rows, with a substantially equal vertical aperture spacing between the centers of each pair of consecutive apertures in each row, and with the vertical rows of apertures being alternately staggered through half the vertical aperture spacing. If the vertical spacing between the centers of the apertures is denoted a, the vertical spacing between two adjacent horizontal rows of apertures is $\frac{1}{2}a$. This spacing is small enough to prevent Moiré phenomena. When the mask is rotated through 90°, the vertical spacing between two horizontal rows of circular apertures will, however, be $\frac{1}{2}a\sqrt{3}$ and thus approximately 1.73 times larger. Since the intensity of the occurring Moiré phenomena increases very strongly with the vertical spacing between two adjacent horizontal rows of apertures, Moiré phenomena will generally occur to an inadmissible degree.

The interested reader will find further background information on Moiré phenomena in color display tubes in the article by P. G. J. Barten, "Theorie des Moiré bei Schattenmasker Farbbildröhren", Valvo Berichte, vol. 15, no. 3, pp. 79–92, November 1969.

However, in accordance with the invention, the occurrence of Moiré phenomena can be prevented by arranging the phosphor triplets vertically instead of horizontally rather than by rotating the aperture pattern of the shadow mask through 90°, in which case both the apertures and the phosphor dots are horizontally elongated. As a result, a satisfactory filling of the display screen is obtained and overlaps are prevented.

If the geometry of the conventional hexagonal mask is used as the basis for the centers of the apertures in the shadow mask, the horizontal dimensions of the phosphor dots are preferably enlarged by the factor of $3/2$ and the vertical dimensions are preferably reduced by a factor of $\sqrt{3}$, so that the phosphor dots should be horizontally elongated, with a length/width ratio of approximately 2.6. Also the mask apertures will then preferably have such a horizontally elongated shape.

However, it is not necessary to use the conventional hexagonal geometry as a basis for the centers of the apertures in the shadow mask. By rendering the horizontal spacing between two vertical rows of apertures equal to half the vertical aperture spacing, an interstitial tetragonal geometry is obtained, which is more favorable for the resolution of the color display tube and in which the length/width ratio is only 1.5.

Intermediate shapes are alternatively possible. For example, a shadow mask may be used in which the horizontal spacing between the vertical rows of apertures is $2/3$ of the vertical aperture spacing. In this case, the phosphor dots will have a length-width ratio of 2.

These and other aspects of the invention are apparent from and will be elucidated with reference to the embodiments described hereinafter.

DESCRIPTION OF THE PREFERRED EMBODIMENT

The relative terms "horizontal" and "vertical", as defined in conventional practice by those skilled in the art, are used throughout the description, including the claims.

Figure 1:
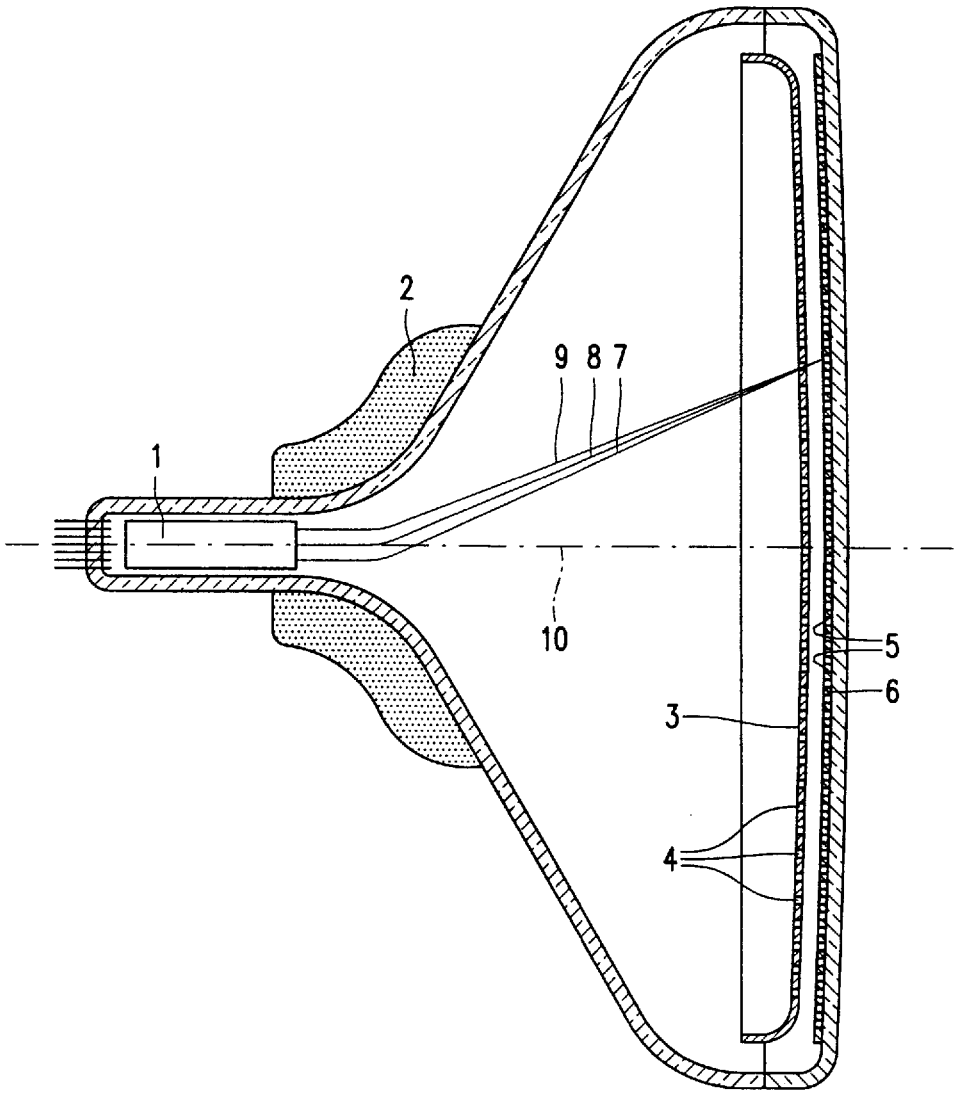
FIG. 1 is a horizontal cross-section through the axis of a conventional color display tube.

FIG. 1 is a horizontal cross-section through the axis of a conventional color display tube. This tube comprises an in-line electron gun, denoted by the reference numeral 1, a self-convergent deflection coil 2, a shadow mask 3, an aperture pattern 4 of the shadow mask 3, a display screen 5, a phosphor coating 6 (consisting of the previously described dot pattern) of the display screen 5, and three electron beams 7, 8 and 9, and the axis 10 of the color display tube.

The structure of the conventional color display tube shown in FIG. 1, as well as its operation and drive modes are well-known to those skilled in the art.

Figure 2:
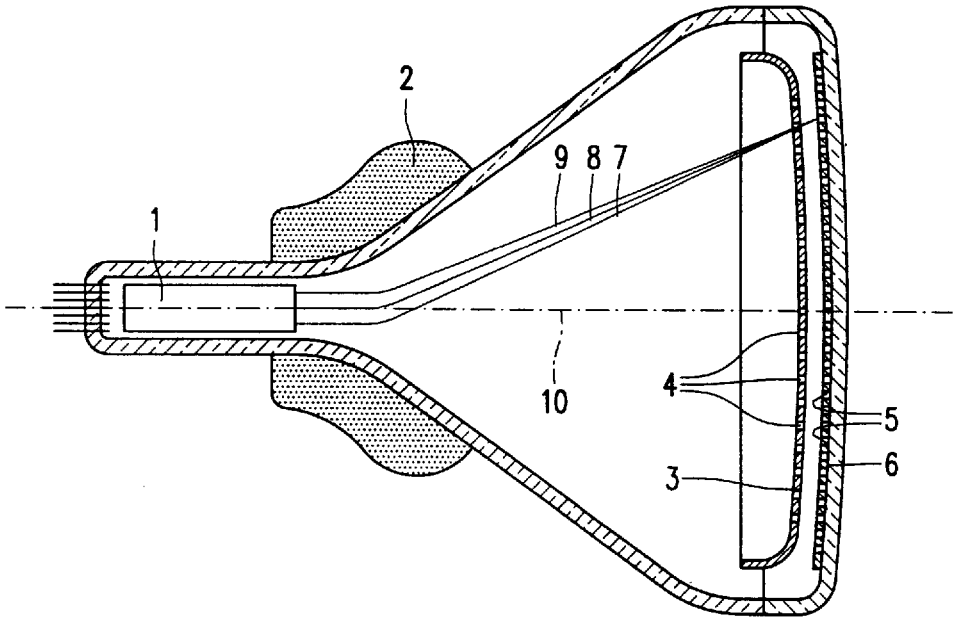
FIG. 2 PRIOR ART
FIG. 2 is a vertical cross-section through the axis of an embodiment of the proposed color display tube.

FIG. 2 is a vertical cross-section through the axis of an embodiment of the color display tube according to the invention. Corresponding parts of the color display tube shown in FIG. 2 are denoted by the same reference numerals as in FIG. 1.

The color display tube of FIG. 2 clearly differs from that of FIG. 1 by the vertical configuration of the electron beams 7, 8 and 9 instead of the horizontal configuration.

Starting from the conventional color display tube shown in FIG. 1 and after carrying out the measure according to the invention, those skilled in the art will readily be able to locate the three electron beams 7, 8 and 9 in a vertical plane and adapt the deflection system, notably the self-convergent deflection coil 2 in such a way that the self-convergence of the electron beams 7, 8 and 9 is maintained.

Figure 3:
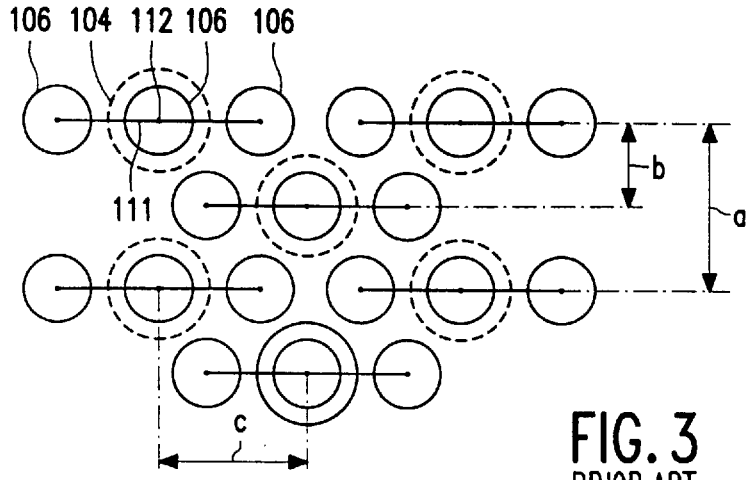
FIG. 3 PRIOR ART
FIG. 3 shows diagrammatically the configuration of a pattern of apertures and a pattern of phosphor dots in a conventional color display tube with a hexagonal shadow mask.
Figure 4:
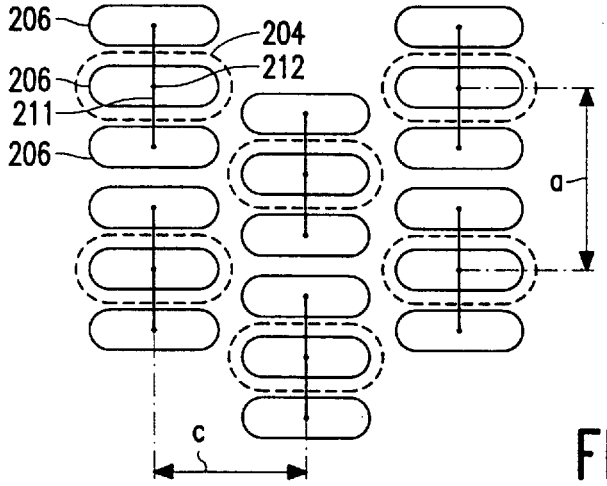
FIG. 4 shows diagrammatically a possible configuration of an aperture pattern and a phosphor dot pattern in a color display tube according to the invention, in which the geometry of the centers of the apertures in the shadow mask is equal to that of a conventional hexagonal shadow mask.
Figure 5:
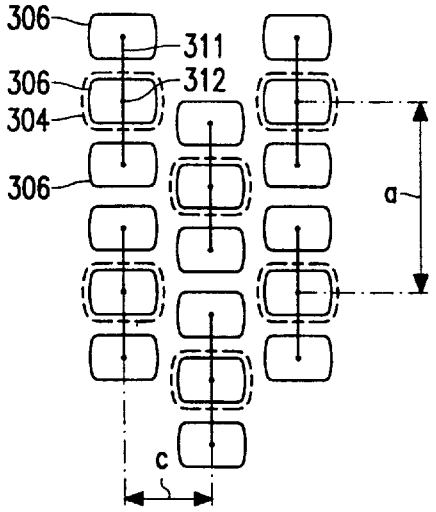
FIG. 5 shows, similarly as in FIG. 4, a further possible configuration of an aperture pattern and a phosphor dot pattern in a color display tube according to the invention, in which the horizontal spacing between the vertical rows of apertures is equal to half the vertical aperture spacing.

Further measures in accordance with the invention will be elucidated with reference to FIGS. 3 to 5 which, for explanatory convenience, show the phosphor dot pattern located in the plane of the respective Figure and the aperture pattern projected in the plane of this Figure, for which reason the aperture contours are shown in broken lines.

FIG. 3 shows diagrammatically the configuration of aperture pattern 4 and phosphor dot pattern 6 in the color display tube of FIG. 1. More particularly, FIG. 3 shows parts of a hexagonal shadow mask with circular apertures 104 and a phosphor dot pattern with horizontal triplets denoted by line 111 and consisting of three phosphor dots 106 each, for example, a green dot in the center and a blue and red dot at the ends of each triplet. The centers of the circular apertures 104 in the hexagonal shadow mask are denoted by the reference numeral 112.

In a hexagonal shadow mask, the apertures 104 are arranged in vertical rows, with a substantially equal vertical aperture spacing, denoted by the reference character a, between the centers 112 of each pair of consecutive apertures 104 in each row, while the vertical rows of apertures 104 are alternately staggered through half the vertical aperture spacing, which staggering is denoted by the reference character b and in which $b=a/2$. The expression "a substantially equal vertical aperture spacing" is used because "an equal vertical" aperture spacing only applies exactly in a central part of the shadow mask of, for example a color display tube having an edge-compliant bounding contour.

When the conventional configuration of shadow mask 3 and display screen shown in FIG. 3 is used in the color display tube of FIG. 2 but with a rotation through 90°, i.e. with vertical triplets 111, then the vertical spacing c between two horizontal rows of apertures 104 will be $\frac{1}{2}\sqrt{3}$ times the spacing a and hence $\sqrt{3}$ times the spacing b in the case without rotation, as is shown in FIG. 3, so that Moiré phenomena will appear.

FIGS. 4 and 5 show possible solutions to the Moiré problem while maintaining the advantage of a reduced deflection defocusing.

FIG. 4 shows diagrammatically a possible configuration of aperture pattern 4 and phosphor dot pattern 6 in a color display tube according to the invention, in which the geometry of the centers 212 of the apertures 204 in the shadow mask 3 is equal to that of a conventional hexagonal shadow mask. As is shown in FIG. 4, the phosphor dots 206 are arranged in vertical triplets denoted by lines 211, while the apertures 204 as well as the phosphor dots 206 are horizontally elongated. In other words, this is a horizontally extending phosphor dot structure, in which the dots 206 may have a rectangular shape with semicircular ends and a corresponding shape of the apertures 204.

Similarly as in the configuration shown in FIG. 3, the configuration in FIG. 4 shows that the horizontal spacing between the vertical rows of apertures 104 and 204, denoted by the reference character c, and expressed in the vertical aperture spacing, denoted by the reference character a, is equal to $\frac{1}{2}a\sqrt{3}$.

In FIG. 5, the horizontal spacing c between vertical rows of apertures 304 is equal to half the vertical aperture spacing a, so that an interstitial tetragonal geometry with a length/width ratio of 1.5 is obtained.

In FIG. 5, the phosphor dots, the triplets and the centers of the apertures are denoted by the reference numerals 306, 311 and 312, respectively.

The color display tube according to the invention may be used to great advantage in a color television set or in a monitor for, for example, a computer.

I claim:

1. A color display tube comprising an in-line electron gun, a self-convergent deflection coil, a shadow mask having a pattern of apertures and a display screen having a pattern of phosphor dots, in which the aperture pattern consists of apertures arranged in vertical rows with a substantially equal vertical aperture spacing between the centers of each pair of consecutive apertures in each row, the vertical rows of apertures being alternately staggered through half the vertical aperture spacing, characterized in that the electron gun is adapted in such a way that it generates three electron beams in the vertical plain through the axis of the color display tube, in that the phosphor dots are arranged in vertical triplets, that both the apertures and the phosphor dots are horizontally elongated , and that the color display tube comprises means for generating a horizontal deflection field for scanning the display screen along a plurality of horizontal lines.

2. A color display tube as claimed in claim 1, characterized in that the horizontal spacing between the vertical rows of apertures of the aperture pattern is smaller than, or equal to, $\frac{1}{2}*\sqrt{3}$ times the vertical aperture spacing.

3. A color display tube as claimed in claim 2, characterized in that the horizontal spacing between the vertical rows of apertures of the aperture pattern is larger than, or equal to, half the vertical aperture spacing.

4. A color television set, characterized in that it comprises a color display tube as claimed in claim 1.

5. A monitor, characterized in that it comprises a color display tube as claimed in claim 1.

* * * * *